US011175048B2

(12) United States Patent
Murad

(10) Patent No.: US 11,175,048 B2
(45) Date of Patent: Nov. 16, 2021

(54) COOKING APPLIANCE

(71) Applicant: Team International Group of America Inc., Miami Gardens, FL (US)

(72) Inventor: Uri Murad, Hollywood, CA (US)

( * ) Notice: Subject to any disclaimer, the term of this patent is extended or adjusted under 35 U.S.C. 154(b) by 0 days.

(21) Appl. No.: 17/176,838

(22) Filed: Feb. 16, 2021

(65) Prior Publication Data

US 2021/0270467 A1 Sep. 2, 2021

Related U.S. Application Data

(60) Provisional application No. 62/982,999, filed on Feb. 28, 2020.

(51) Int. Cl.
*F24C 15/02* (2006.01)
*F24C 15/16* (2006.01)

(52) U.S. Cl.
CPC ..... *F24C 15/028* (2013.01); *F24C 15/16* (2013.01)

(58) Field of Classification Search
CPC ..... F24C 15/028; F24C 15/16; F24C 7/053; A47J 37/0623; A47J 27/002
See application file for complete search history.

(56) References Cited

U.S. PATENT DOCUMENTS

| | | | | |
|---|---|---|---|---|
| 370,849 A | | 10/1887 | Baxter | |
| 1,208,637 A | | 12/1916 | Phelps | |
| 2,024,386 A | | 12/1935 | Phelps | |
| 2,707,225 A | | 4/1955 | Pearce | |
| 2,708,709 A | | 5/1955 | Pearce | |
| 2,798,930 A | | 7/1957 | Frost | |
| 2,889,825 A | | 6/1959 | Evans | |
| 3,009,458 A | | 11/1961 | Pearce | |
| 3,548,154 A | | 12/1970 | Christiansson | |
| 4,780,597 A | | 10/1988 | Linhart et al. | |
| 5,272,317 A | * | 12/1993 | Ryu | F24C 7/06 219/392 |
| 5,618,458 A | | 4/1997 | Thomas | |
| 6,355,914 B1 | * | 3/2002 | Stockley | H05B 3/0076 219/482 |
| 6,362,458 B1 | | 3/2002 | Sargunam et al. | |
| 6,545,251 B2 | * | 4/2003 | Allera | F24C 7/06 126/339 |

(Continued)

FOREIGN PATENT DOCUMENTS

| | | | | |
|---|---|---|---|---|
| CN | 1231153 A | * | 10/1999 | F24C 15/16 |
| GB | WO20180199766 A1 | * | 2/2018 | H05B 6/02 |

*Primary Examiner* — David J Laux
*Assistant Examiner* — Nikhil P Mashruwala
(74) *Attorney, Agent, or Firm* — Frank Marino

(57) ABSTRACT

A cooking appliance includes a cooking cavity, a first heating element disposed adjacent a top of the cooking cavity, a second heating element disposed adjacent a bottom of the cooking cavity, first temperature sensor disposed adjacent the top of the cooking cavity, a second temperature sensor disposed adjacent the bottom of the cooking cavity, a blower arranged to agitate air within the cooking cavity, a cookware device removably disposed atop and in thermal contact with the second heating element and the second temperature sensor, and a controller adapted to manually receiving cooking parameters from a user and sensed temperature information from the first and second temperature sensors and to independently and selectively control the heating elements and the blower according thereto.

14 Claims, 20 Drawing Sheets

(56) References Cited

U.S. PATENT DOCUMENTS

| | | | | |
|---|---|---|---|---|
| 6,891,133 | B2 | 5/2005 | Shozo et al. | |
| 6,917,017 | B2 * | 7/2005 | Moon | A47J 37/0623 126/21 A |
| 7,064,296 | B1 * | 6/2006 | Harned | F24C 15/026 126/190 |
| 7,368,685 | B2 | 5/2008 | Nam et al. | |
| 7,735,480 | B2 | 6/2010 | Larsen et al. | |
| 7,814,897 | B2 | 10/2010 | Larsen | |
| 8,226,180 | B2 | 7/2012 | Patiil et al. | |
| 8,336,535 | B2 | 12/2012 | Larsen et al. | |
| 8,510,991 | B2 | 8/2013 | Collene | |
| 8,878,106 | B2 * | 11/2014 | Hensel | A47J 37/0635 219/483 |
| 8,944,536 | B2 | 2/2015 | Yantis et al. | |
| 9,188,346 | B2 | 11/2015 | Yantis et al. | |
| 9,328,929 | B2 | 5/2016 | Yantiis et al. | |
| 9,494,323 | B2 | 11/2016 | Yantis et al. | |
| 9,644,848 | B2 | 5/2017 | Yantis et al. | |
| 9,651,265 | B2 | 5/2017 | Yantis et al. | |
| 9,756,981 | B2 * | 9/2017 | Fung | A47J 37/0623 |
| 9,777,927 | B2 * | 10/2017 | Armstrong | F24C 7/085 |
| 9,890,957 | B2 | 2/2018 | Yantis et al. | |
| 9,924,830 | B1 * | 3/2018 | Glucksman | F24C 15/18 |
| 10,018,364 | B2 | 7/2018 | Yantis et al. | |
| 10,088,173 | B2 * | 10/2018 | McKee | A21B 1/245 |
| 10,791,872 | B2 * | 10/2020 | Nernberger | F24C 15/22 |
| 2007/0029311 | A1 * | 2/2007 | Akashi | A23L 3/365 219/625 |
| 2016/0123600 | A1 * | 5/2016 | Phillips | H04L 12/2825 99/337 |
| 2021/0222889 | A1 * | 7/2021 | Johnson | F24C 3/128 |

* cited by examiner

COOKING APPLIANCE

FIELD OF THE INVENTION

The invention relates to cooking appliances. More specifically, it relates to countertop electric ovens, particularly such an oven having versatility to roast, convection-bake, broil, air-fry, grill, and griddle foods, and having a convenient and safe access arrangement.

BACKGROUND

Electric ovens are well known and typically fall within several categories; microwave ovens, steam ovens, radiant ovens, convection ovens, and fan-forced convection ovens. Microwave ovens cook by directing microwave energy into moisture within food to heat it. Steam ovens expose food to penetrating hot steam which may be produced by a heating element immersed in water. Radiant ovens include a heating element that exposes the food to waves of radiant heat. Convection ovens include a heating element that heats air within the oven to roast or bake the food. And fan-forced convection ovens add a fan to a convection oven to move the heated air, which is found to reduce cooking time and increase cooking evenness.

Air Fryers are well known and are an extreme form of fan-forced convection oven in which high temperature air at a high airflow rate is applied to oily food or food that has been coated in oil to brown the food in a manner that mimics the browning, crispiness, and flavor of deep frying, but without the mess, danger, and calories.

Surface cooking is another known method of cooking certain foods in which the food is placed onto a heated surface, such as a frying pan or a griddle, and the food is cooked from below. Fatty foods cooked by frying tend to simmer in their released fats, which may on one hand add flavor, but on the other hand increase calories.

Broiling is another known method of cooking certain foods in which a heating element is disposed above the food so that the food is exposed to both convection and radiant heat from above. Broiling can better brown certain foods and while it may have a drying effect, it results in less calories provided the food is placed on a draining surface such as a grill.

The interior of electric ovens and the food being cooked therein can obviously be very hot. For safety, it is preferable that they oven be configured to allow insertion and removal of the food with minimal exposure to that heat and the things it has heated. And because the user will typically need to hold the food in one hand while opening the oven, it is preferable that the insertion and removal can be accomplished with only one hand while access to the oven can be accomplished with only the other. And for energy efficiency it is preferable to only open the oven for the insertion and removal of food to the extent needed, according to the size of the food or the carrying it. These features become more important according to the method of cooking and the type/shape of the food, so in a cooker that provides multiple cooking modes and expects to receive many types of foods, these features must perform optimally for each.

There exists the need to provide, and such may be an object of the invention, an apparatus which can selectively perform one or more of the tasks of roasting, baking, air-frying, broiling, convection-baking, and surface cooking.

There exists the need to provide, and such may be an object of the invention, an apparatus which can expedite and enhance the grilling of foods, use space more efficiently, and reduce cooking smoke and food greasiness.

There exists the need to provide, and such may be an object of the invention, such an apparatus that has a door system which opens from its center outwardly and only as wide as needed to receive or release the food being cooked. And there exists the need to provide, and such may be an object of the invention, such an apparatus that opens symmetrically with only the other hand.

Further needs and objects of the invention will become apparent upon a review of the following disclosure of an exemplary embodiment.

SUMMARY OF THE INVENTION

The invention may be embodied in or practiced using a cooking appliance which can selectively perform one or more of the tasks of roasting, baking, air-frying, broiling, convection-baking, and surface cooking.

The invention may be embodied in or practiced using a cooking appliance including; a housing defining a cooking cavity, a door arrangement for selectively accessing the cooking compartment, a first heating element disposed adjacent a top of the cooking cavity, a second heating element disposed adjacent a bottom of the cooking cavity, first temperature sensor disposed adjacent the top of the cooking cavity, a second temperature sensor disposed adjacent the bottom of the cooking cavity, a blower arranged to agitate air within the cooking cavity, a cookware device removably disposed atop and in thermal contact with the second heating element and the second temperature sensor, and a controller adapted to manually receiving cooking parameters from a user and sensed temperature information from the first and second temperature sensors.

The controller may include a timer and be adapted to independently and selectively control in cooperation with the timer and according to the cooking parameters and the sensed temperature information; one or both of the blower's on/off state and the blower's speed, one or both of the first heating element's on/off state and the first heating element's speed, or one or both of the second heating element's on/off state and the second heating element's speed.

The invention may be embodied in or practiced using such an appliance that has a door system which opens from its center outwardly, only as wide as needed to receive or release the food being cooked, and that opens symmetrically with the use of only one hand.

The invention may be embodied in or practiced using such an appliance which includes or is adapted to receive removable cooking components such as a griddle, grill, pie plate, rice pot, casserole dish, etc.

The invention may be embodied in or practiced using such an appliance wherein the appliance and the removable cooking components interact to optimize performance, and wherein the appliance recognizes the type of food inserted therein through user input and adjusts its performance accordingly.

Further features and aspects of the invention are disclosed with more specificity in the Description and Drawings provided herein and showing exemplary embodiments of the invention.

BRIEF DESCRIPTION OF THE DRAWINGS

An exemplary embodiment of a grilling oven with air fryer in accordance with or useful in practicing the invention is shown in the accompanying Drawings, of which.

DESCRIPTION OF AN EXEMPLARY EMBODIMENT

Figure 1:
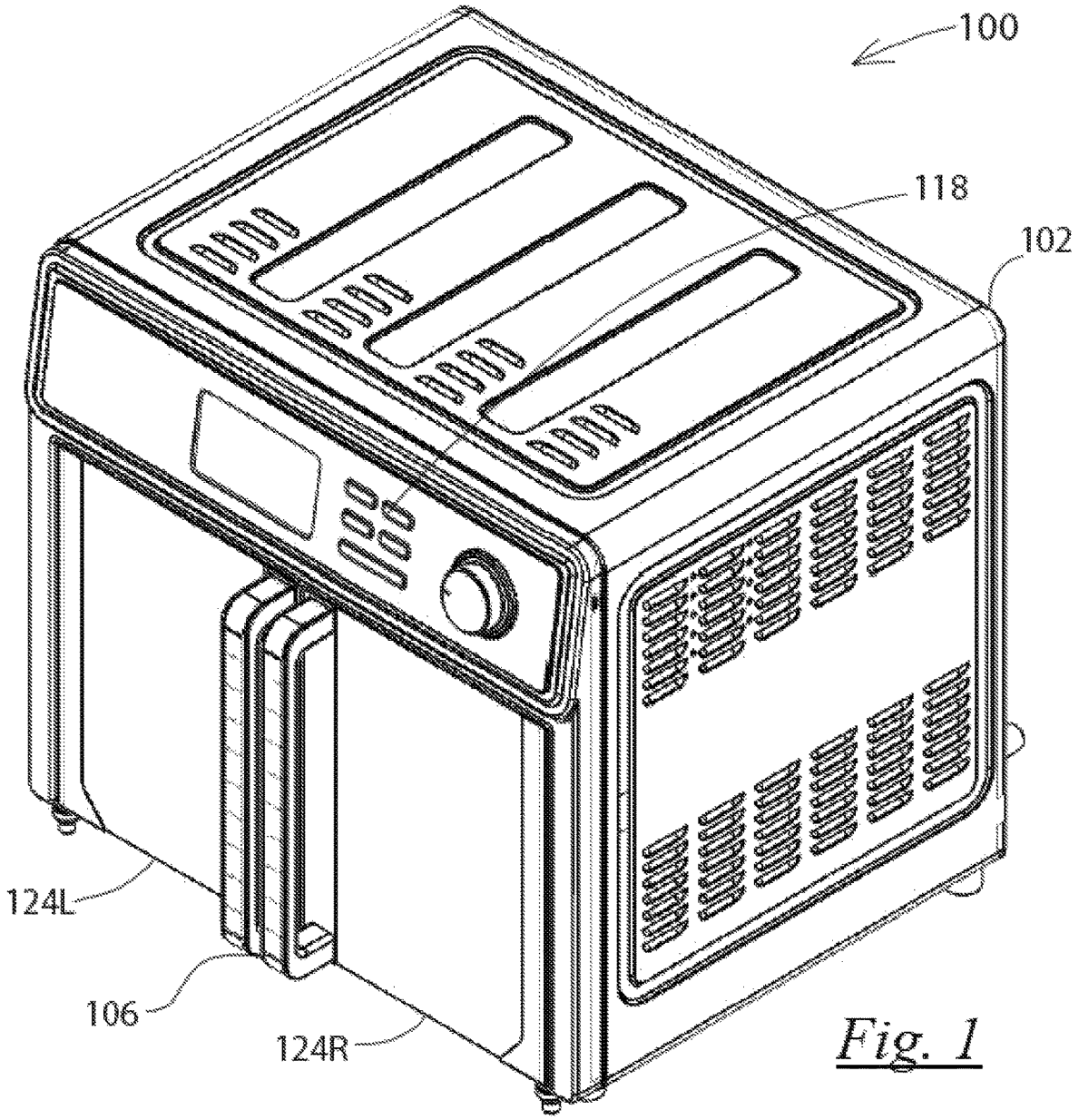
FIG. 1 is a perspective view of an exemplary cooking appliance according to or useful in practicing the invention, in its closed state.
Figure 2:
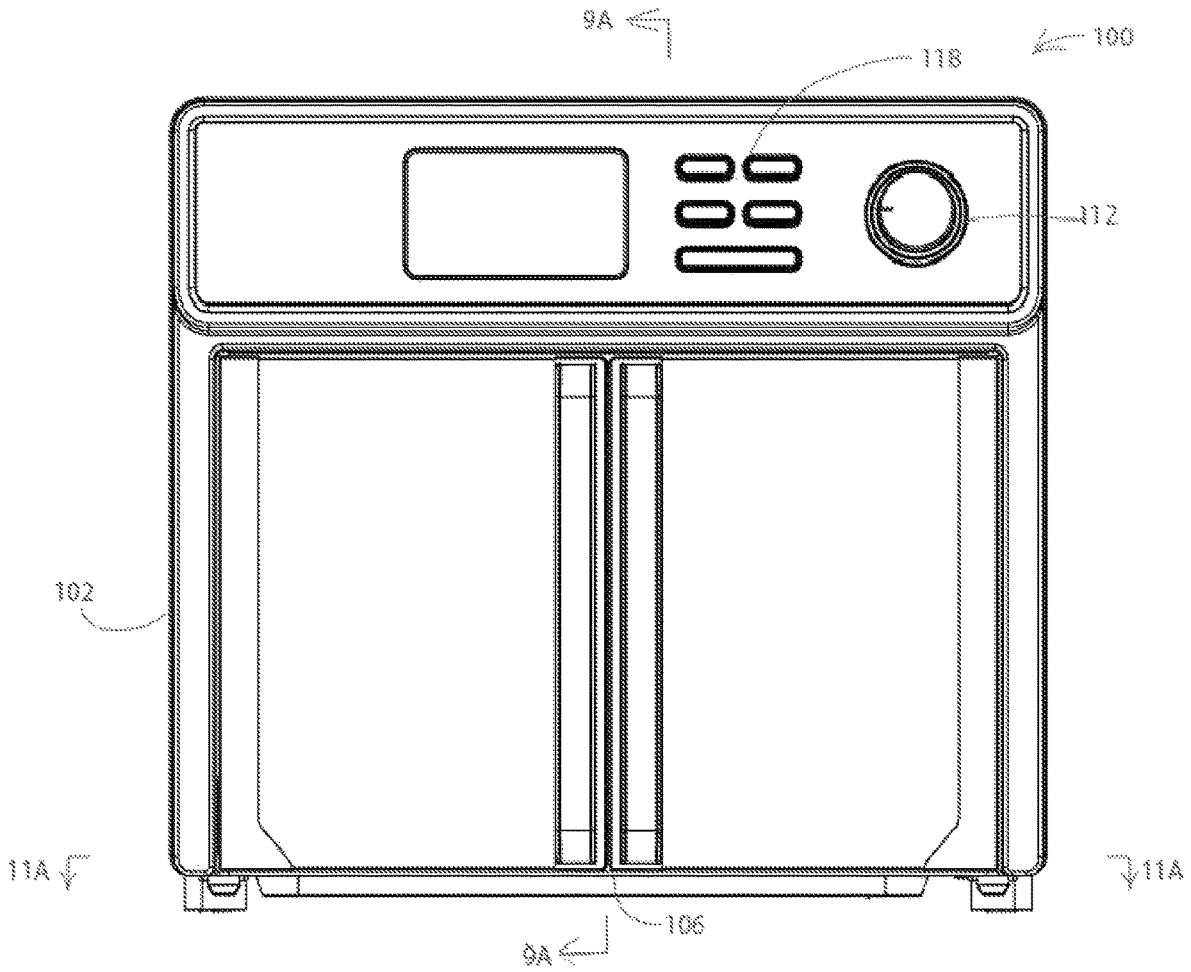
FIG. 2 is a front view of the appliance of FIG. 1 in its closed state.
Figure 3:
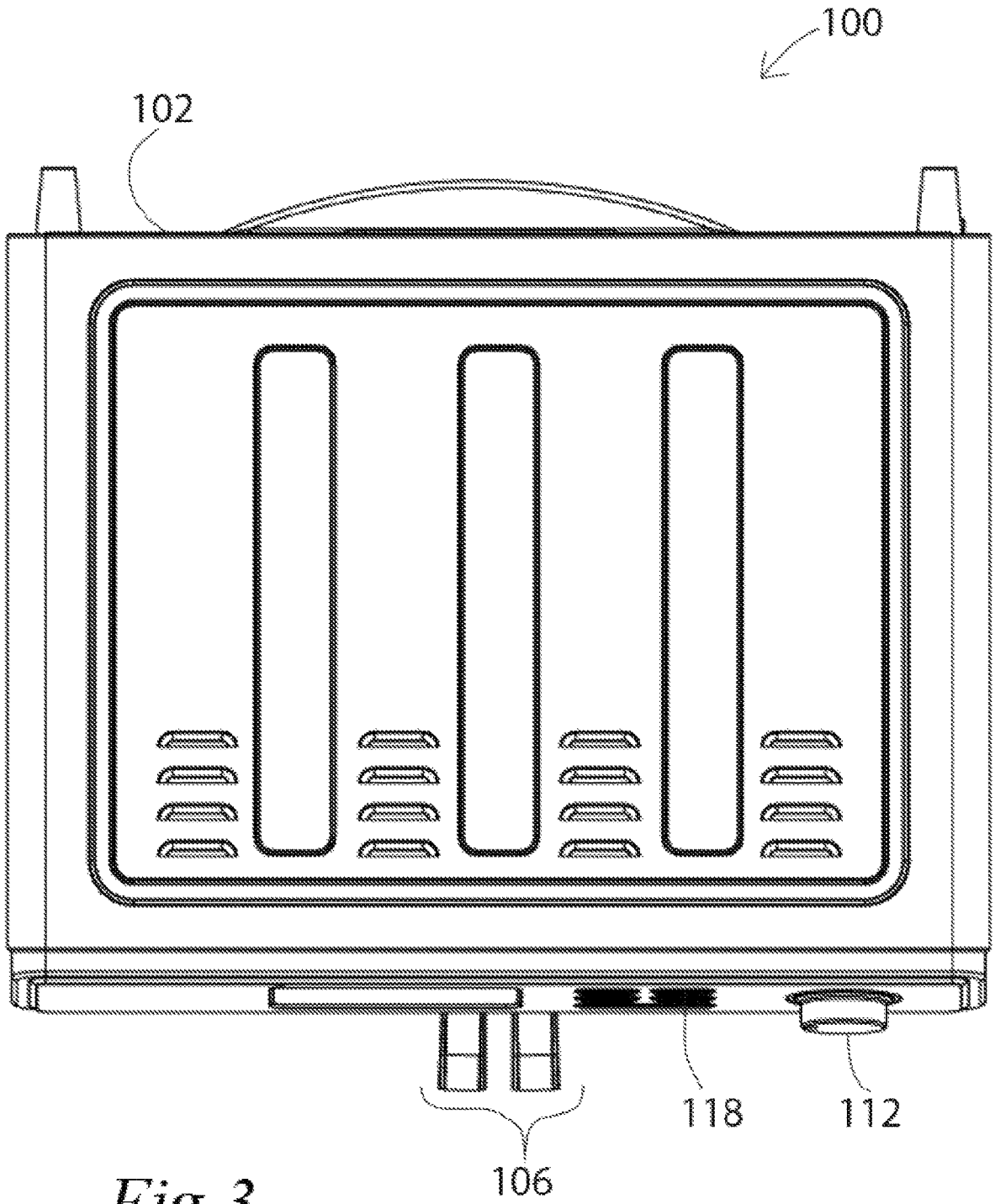
FIG. 3 is a top view of the appliance of FIG. 1 in its closed state.
Figure 4:
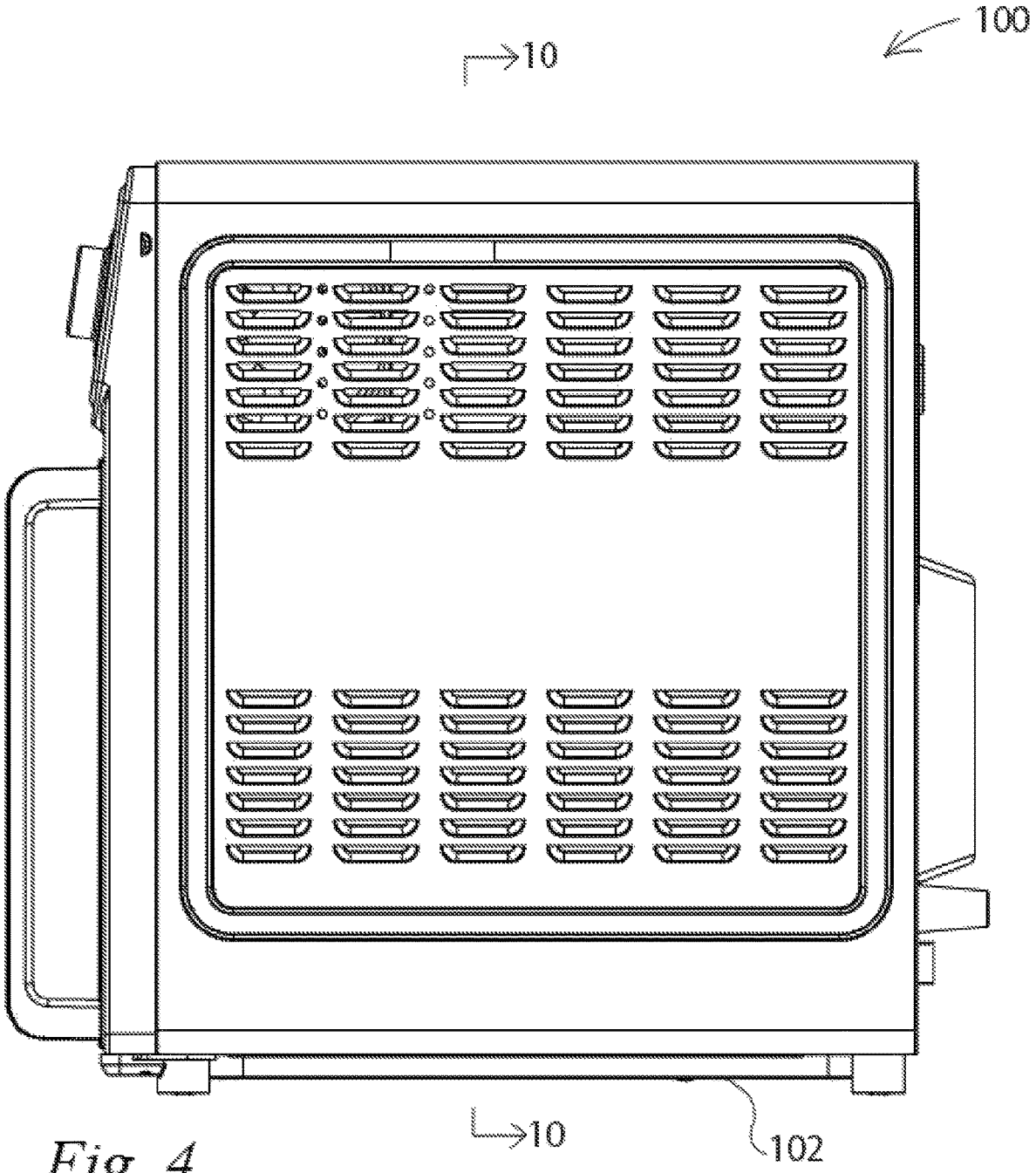
FIG. 4 is a side view of the appliance of FIG. 1 in its closed state.
Figure 5:
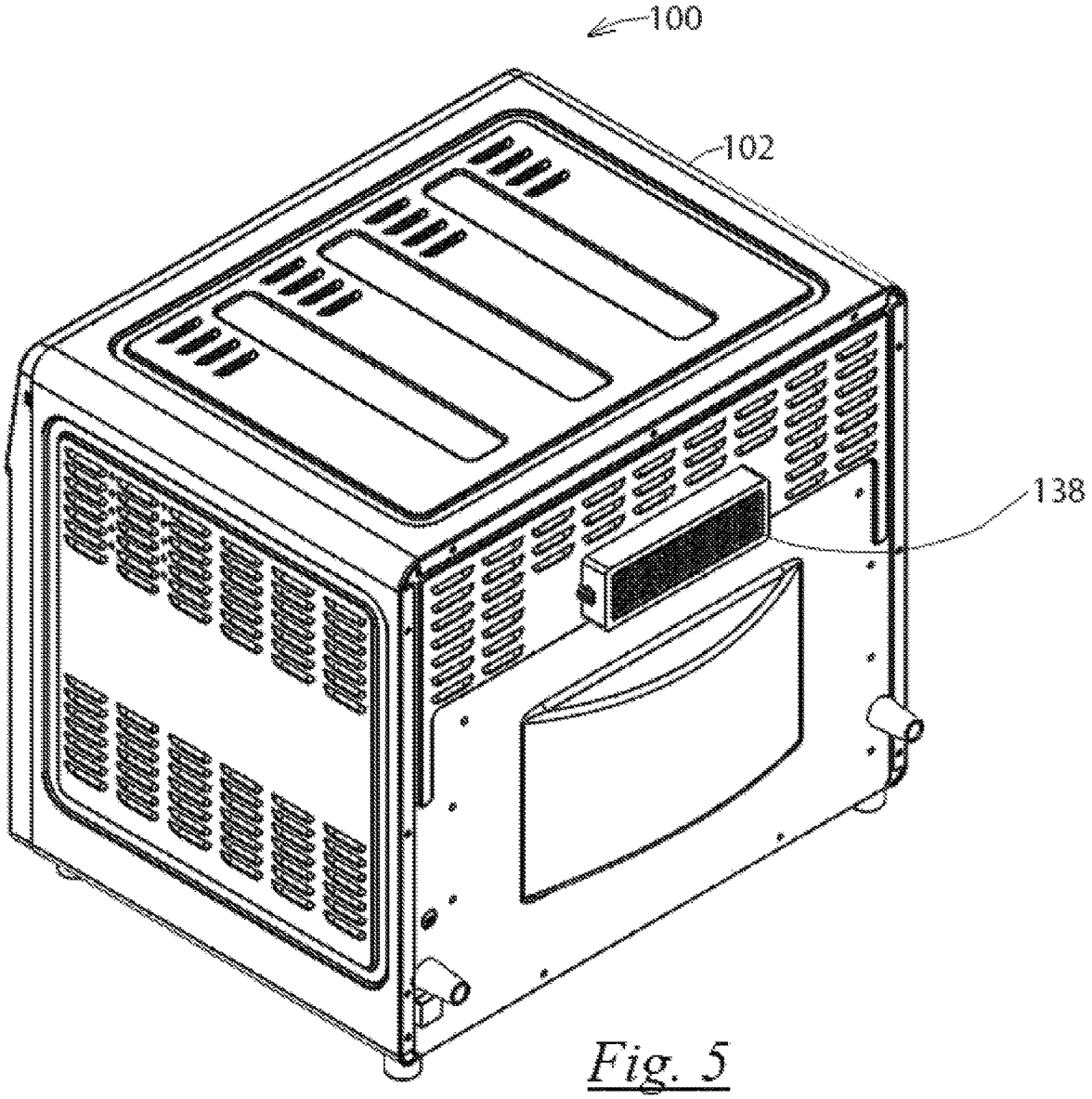
FIG. 5 is a rear perspective view of the appliance of FIG. 1 in its closed state.
Figure 6A:
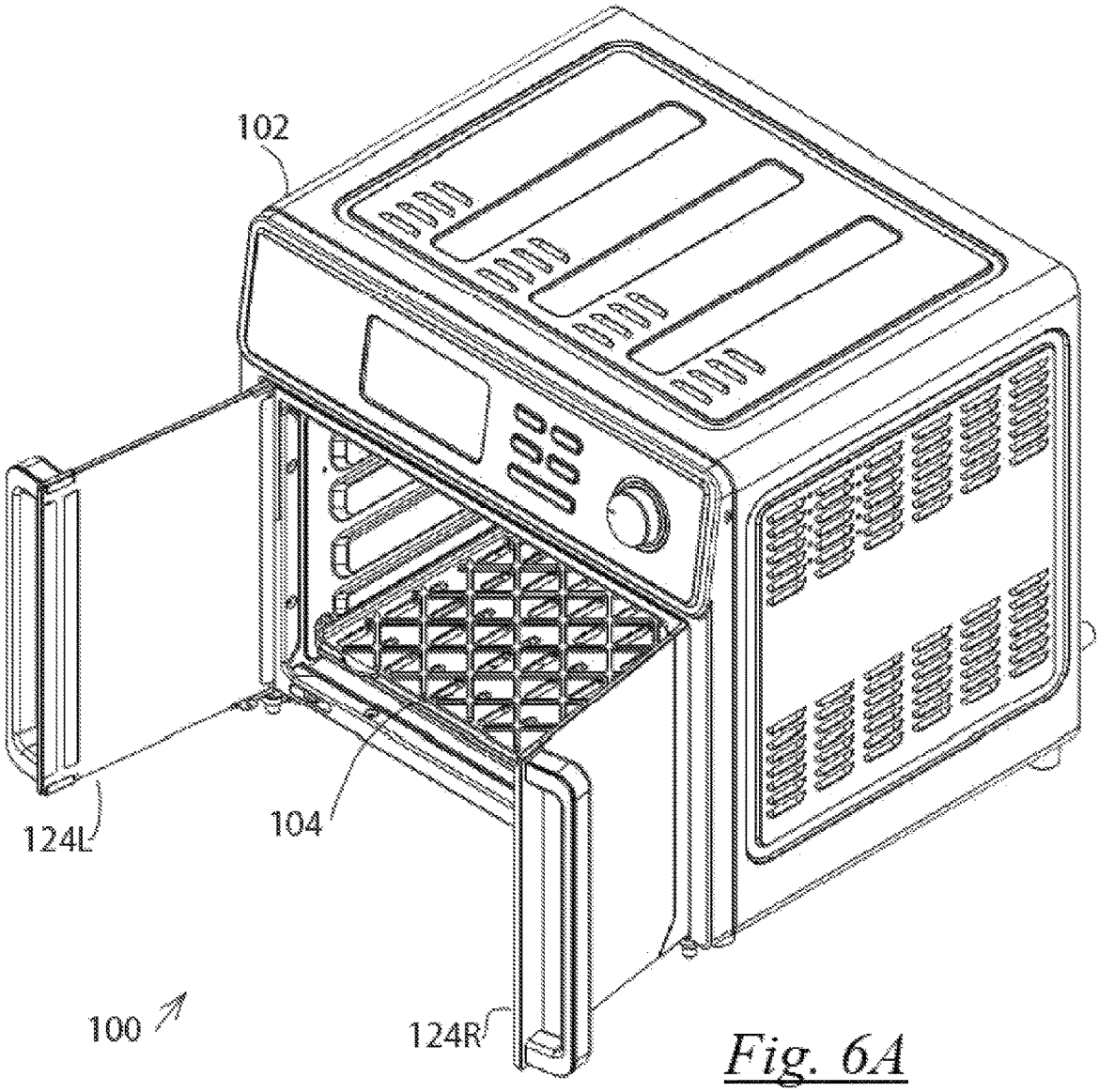
FIG. 6A is a perspective view of the appliance of FIG. 1 in its opened state.
Figure 6B:
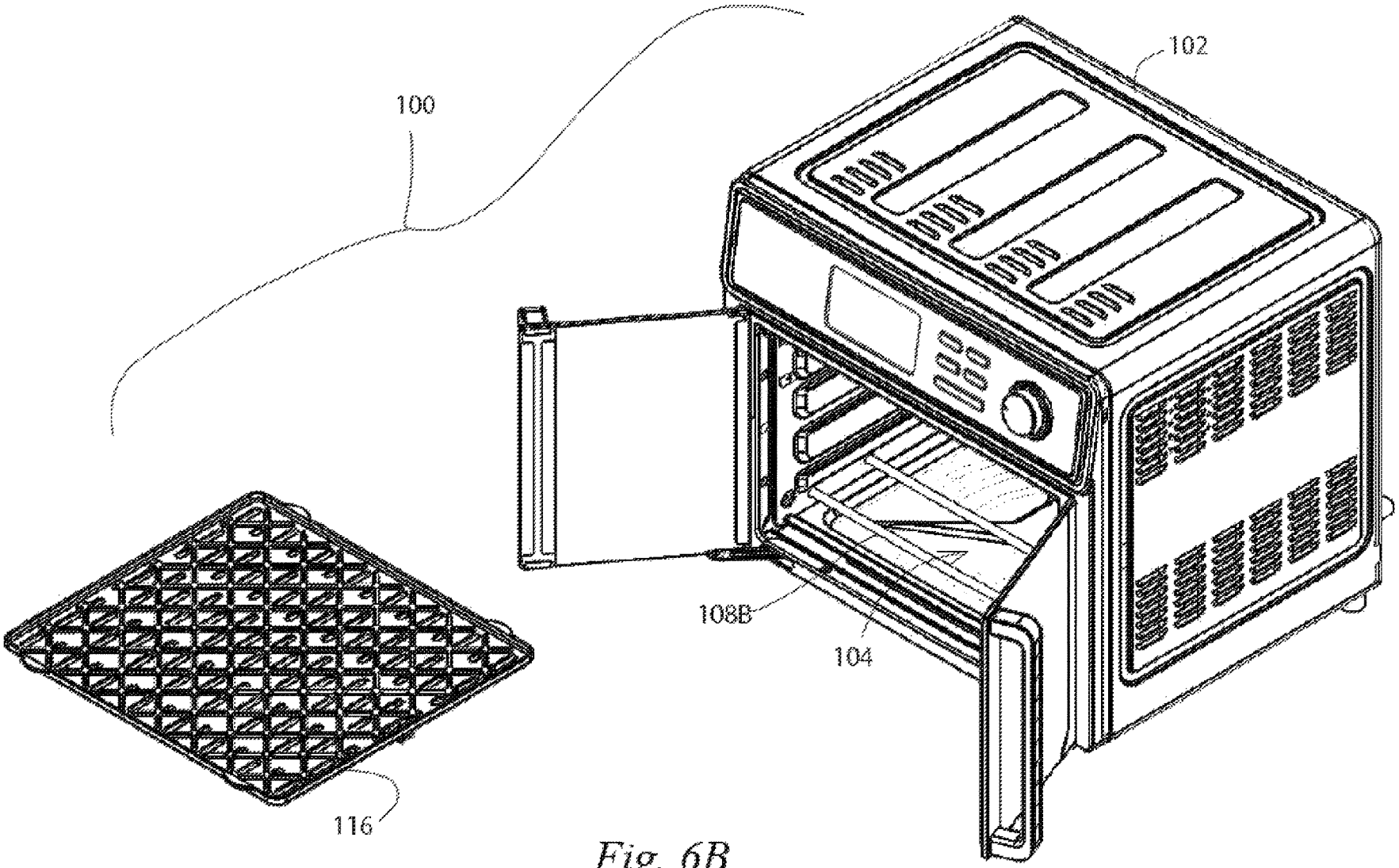
FIG. 6B is a perspective view of the appliance of FIG. 1 in its opened state with its griddle plate removed.
Figure 7A:
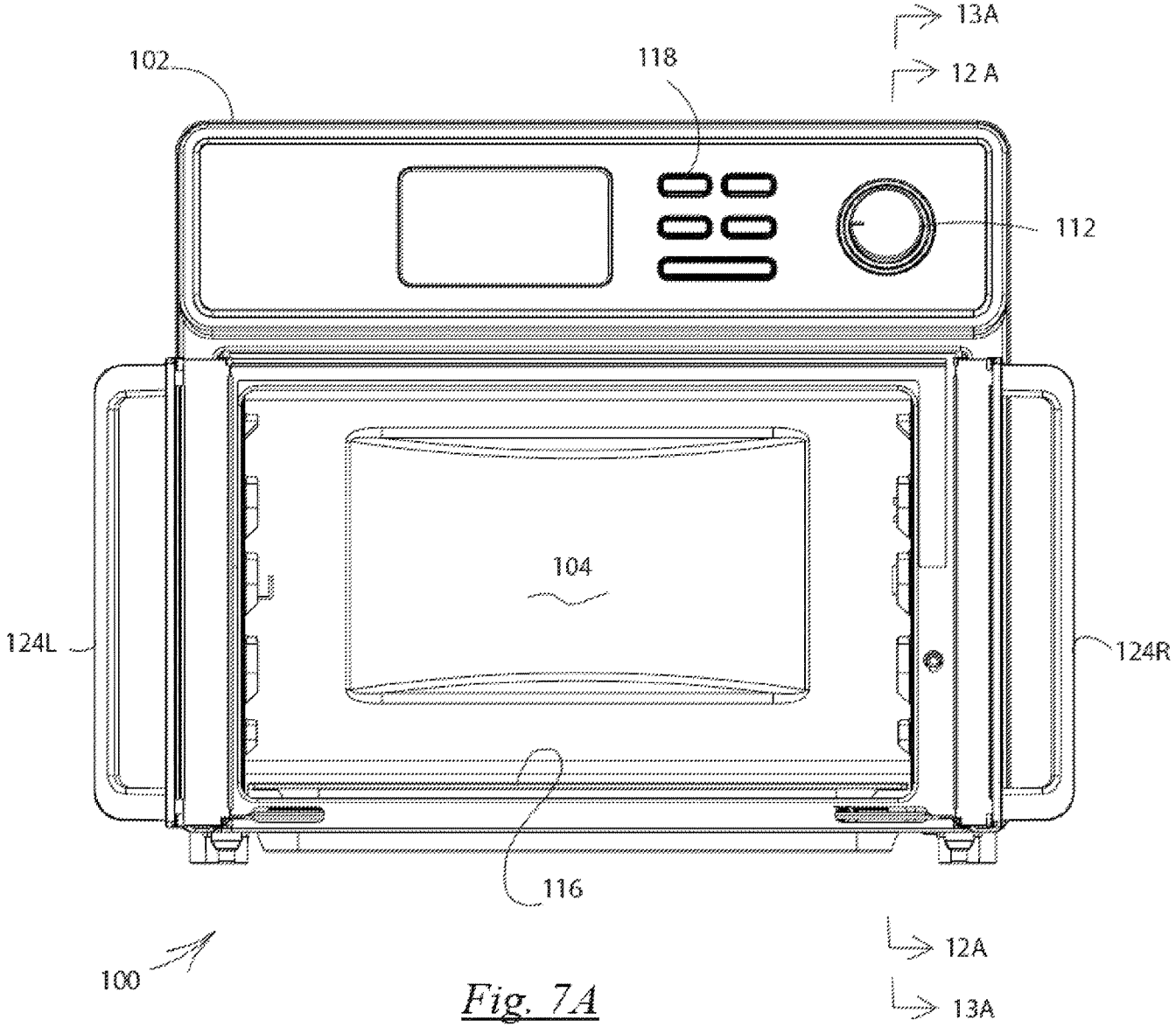
FIG. 7A is a front view of the appliance of FIG. 1 in its opened state.
Figure 7B:
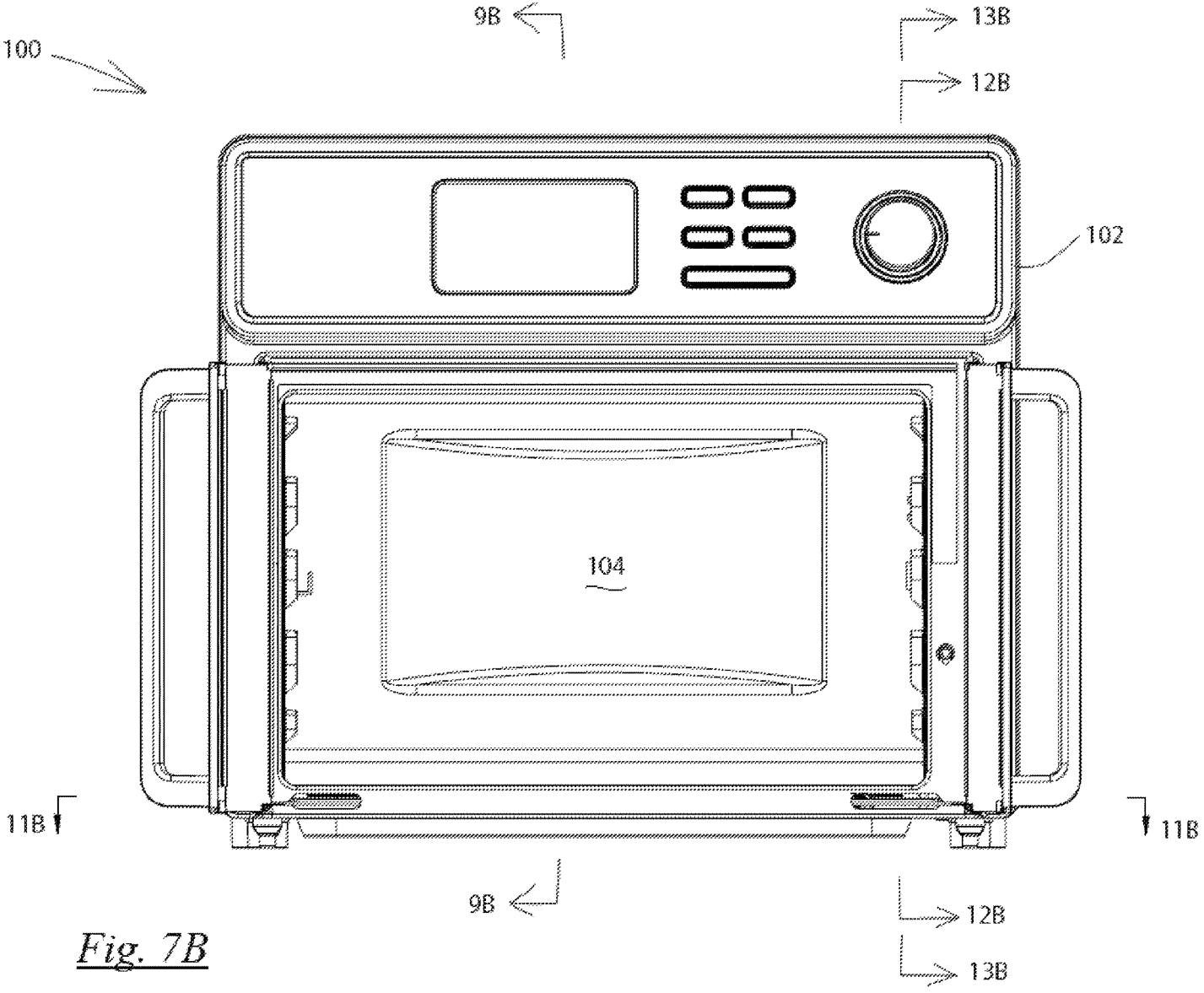
FIG. 7B is a front view of the appliance of FIG. 1 in its opened state with its griddle plate removed.
Figure 8:
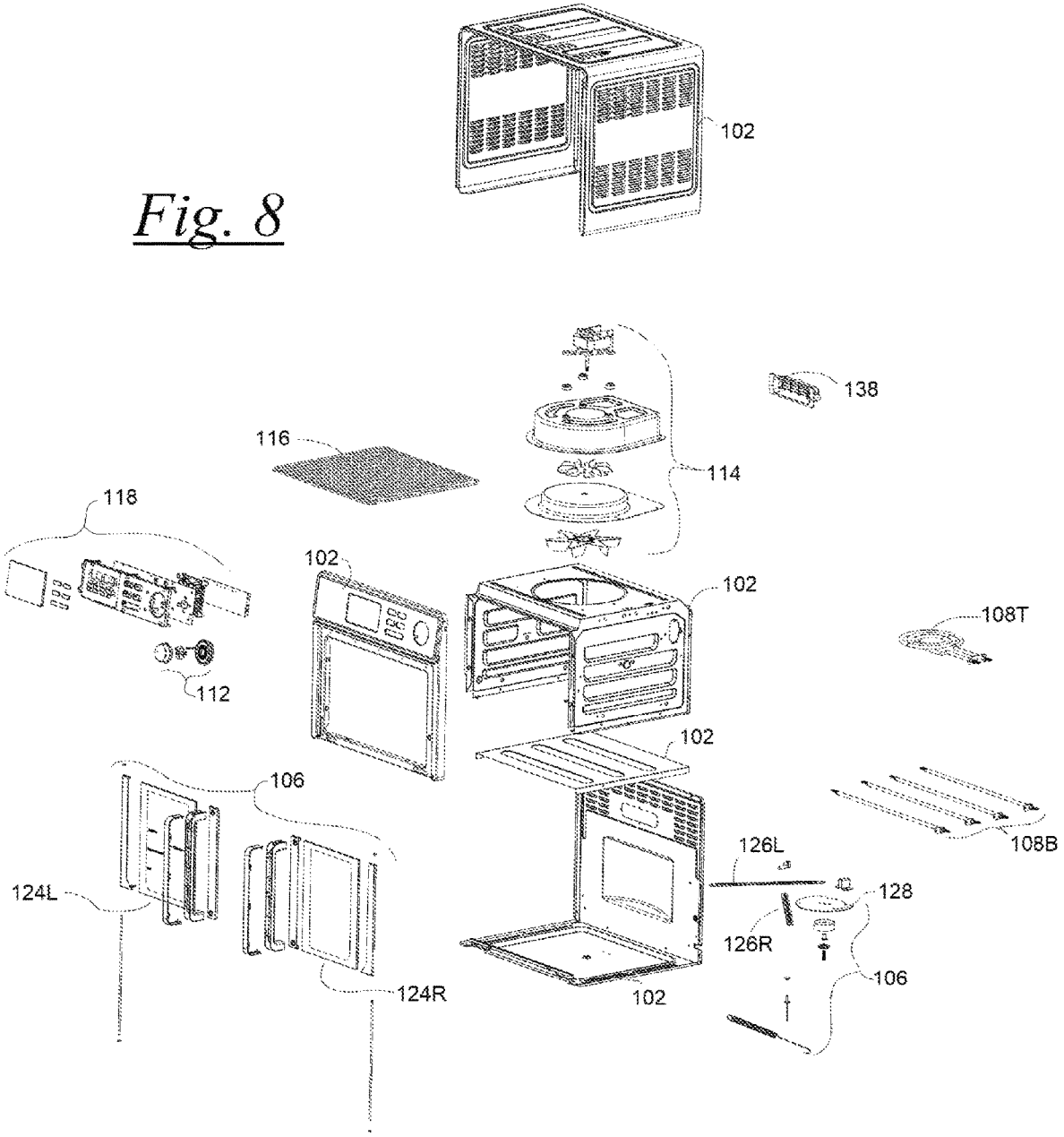
FIG. 8 is an exploded view of the appliance of FIG. 1.
Figure 9A:
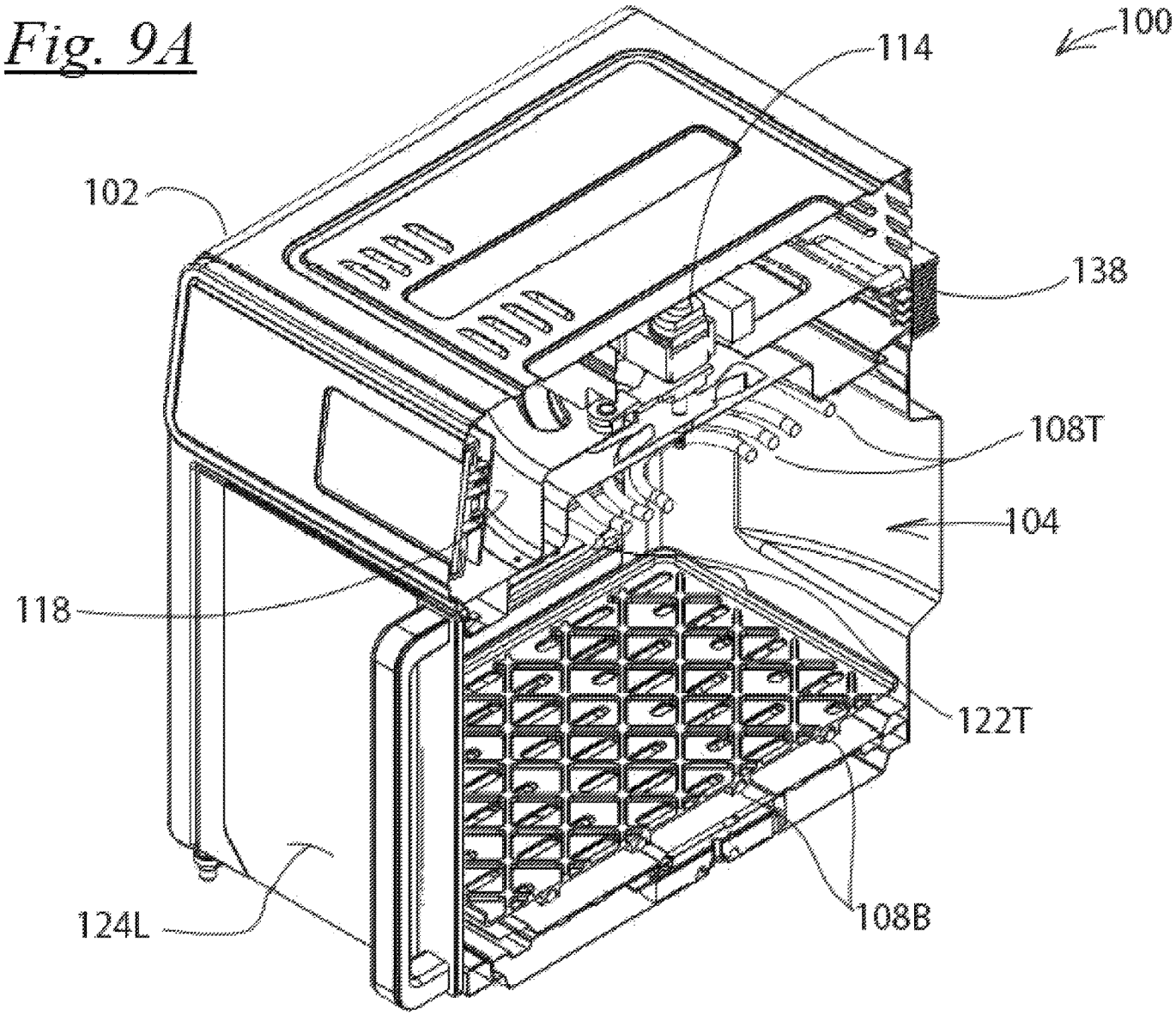
FIG. 9A is a perspective cross-sectional view of the appliance of FIG. 1 in its closed state, taken at Line 9A-9A of FIG. 2.
Figure 9B:
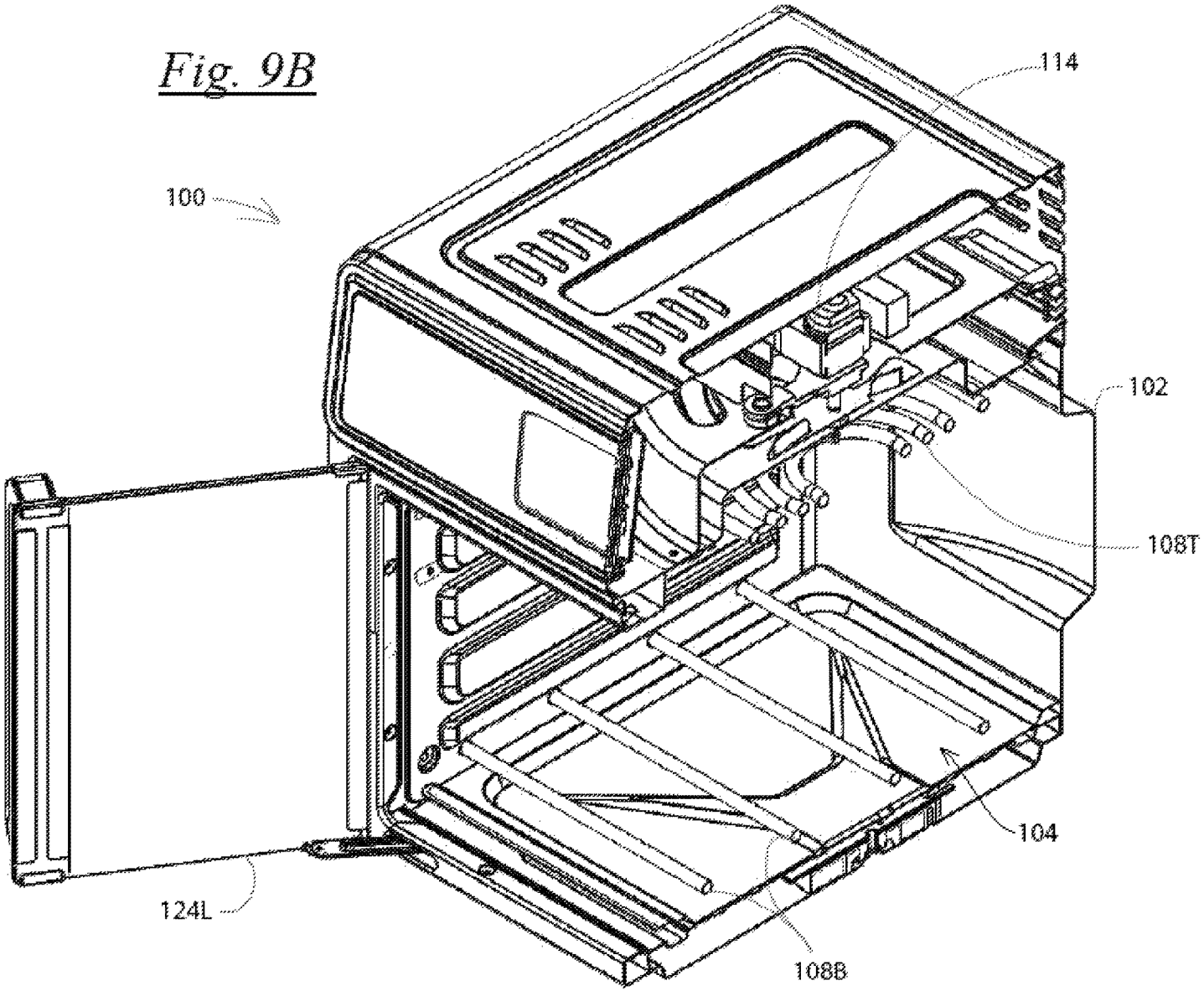
FIG. 9B is a perspective cross-sectional view of the appliance of FIG. 1 in its closed state, taken at Line 9B-9B of FIG. 7B.
Figure 10:
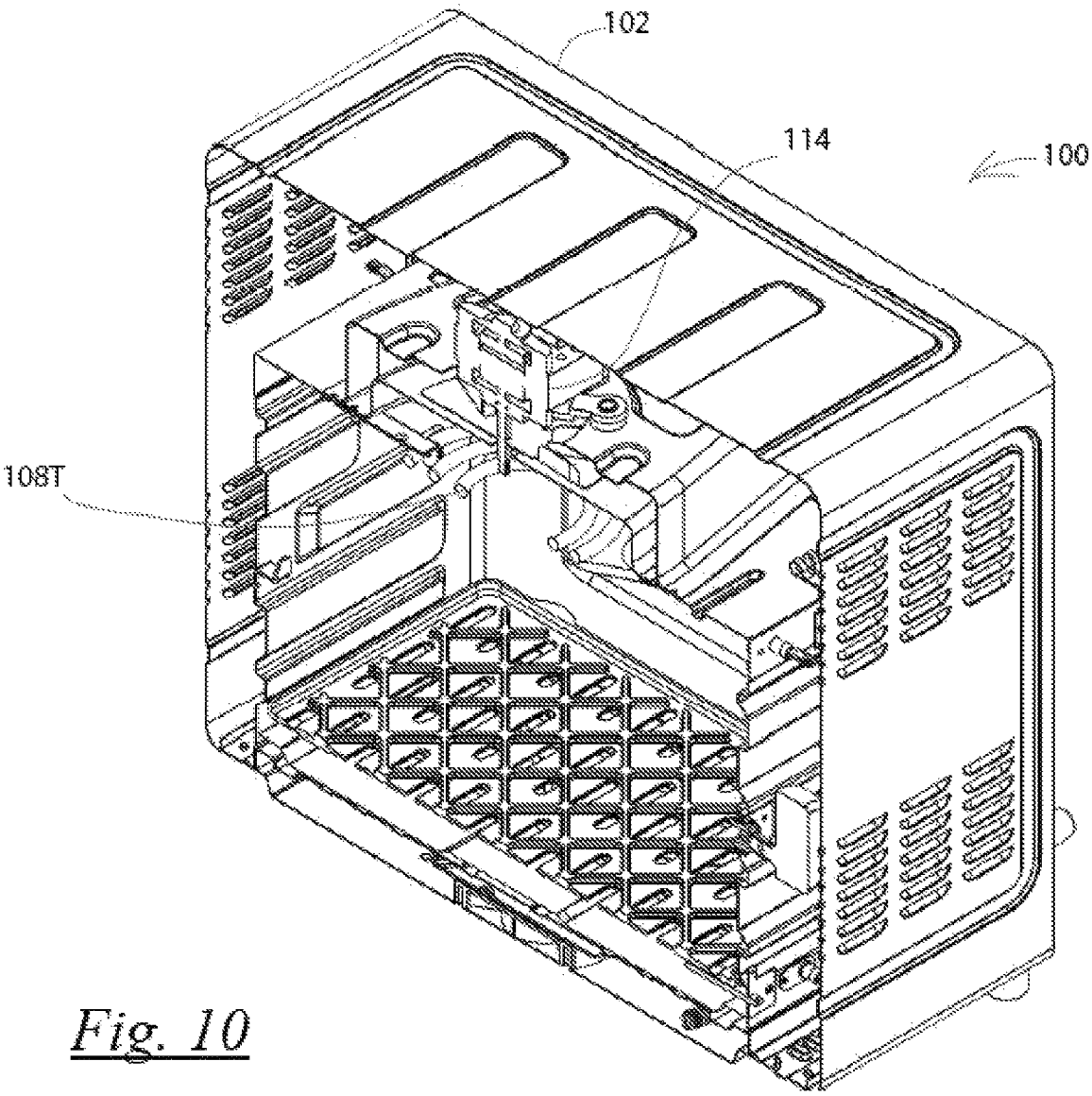
FIG. 10 is a perspective cross-sectional view of the appliance of FIG. 1 taken at Line 10-10 of FIG. 4.

Referring to FIGS. 1 through 16 there is shown an exemplary cooking appliance, here embodied as electrical countertop grilling oven and air frying appliance 100. A housing 102 defines a cooking cavity 104. A door arrangement 106 allows the user to selectively access the cooking compartment. A first electrical heating element 108T is disposed adjacent atop of the cooking cavity. A second electrical heating element 108B is disposed adjacent a bottom of the cooking cavity. A blower 114 is arranged to agitate air within the cooking cavity. A cookware device, embodied here as griddle plate 116, is removably disposed atop and in thermal contact with the second electrical heating element. A controller 118 includes an input interface and a timer 112 and is adapted to manually receive cooking parameters from the user and to independently energize the electrical heating elements according thereto. The cooking parameters include information including when, for how long, and at what intensity to operate each of the heating elements and the blower. A first temperature sensor 122T is disposed near the top of the cooking cavity and is adapted to sense the air temperature within the cooking chamber and report the same to the controller. A second temperature sensor 122B is disposed near to the bottom of the cooking chamber and is arranged to contact the griddle plate and adapted to sense its temperature and report the same to the controller. Because the grilling plate is to be in immediate thermal contact with food being cooked, the sensed temperature by the second temperature sensor is proportional to and gives the controller an indication of the temperature of the food. The controller energizes one or more of the electrical heating elements and the blower in accordance with the air and griddle temperatures in accordance with the cooking parameters. Energization may include, turning the blower and heating elements on and off individually and independently for intermittent periods of time according to the timer and the cooking parameters, increasing and decreasing the intensity of the blower and heating elements individually and independently for intermittent periods of time according to the timer and the cooking parameters, or increasing and decreasing the intensity of the blower and heating elements individually and independently continuously according to the timer and the cooking parameters.

And the agitated air may not always need to be hot air. In some cases, it may be beneficial to agitate the air without one or both of the heating elements being energized. For instance, the appliance may serve as an unheated food dehydrator or a cooked food may wish to be cooled to serving temperature by exposure to agitated cool air for a period of time.ly need to be heated The door arrangement includes left and right outwardly-opening doors, 124L and 124R, respectively. The doors are linked together to open and close symmetrically such that opening or closing either one will cause a symmetrical opening or closing of the other.

The sensors are NTC (negative thermal coefficient) devices adapted to alter resistant inversely according to the sensed temperature, but any known and functionally operable form of temperature detection means could be substituted therefore. The first electrical heating element is an air-heating element and the second electrical heating element is a contact heating element. The heating elements are tubular "cal-rod" type elements, but any known and functionally operable form of heating means could be substituted therefore. The griddle plate has perforations 140 to allow the agitated air to pass there-through, but need not be so perforated according to the type of food being cooked and the cooking results being desired. For instance, fried chicken may cook best on a perforated griddle plate while fatty bacon may be better cooked on an unperforated grilling plate to capture the liquid fats produced during cooking. Other foods such as casseroles may be best cooked in a side-walled plate (pan). Pies may be best cooked in a pie plate. Deeper cookware devices such as rice pots or casserole dishes may could benefit from the heat generated at the bottom of the cavity and/or hot and/or agitated.

As long as the cookware device is able to contact the second temperature sensor and the cooking parameters for the food therein are properly input, the air and food can be properly monitored and the heating element and blower operation can be managed with consideration of the food temperature.

Figure 11A:
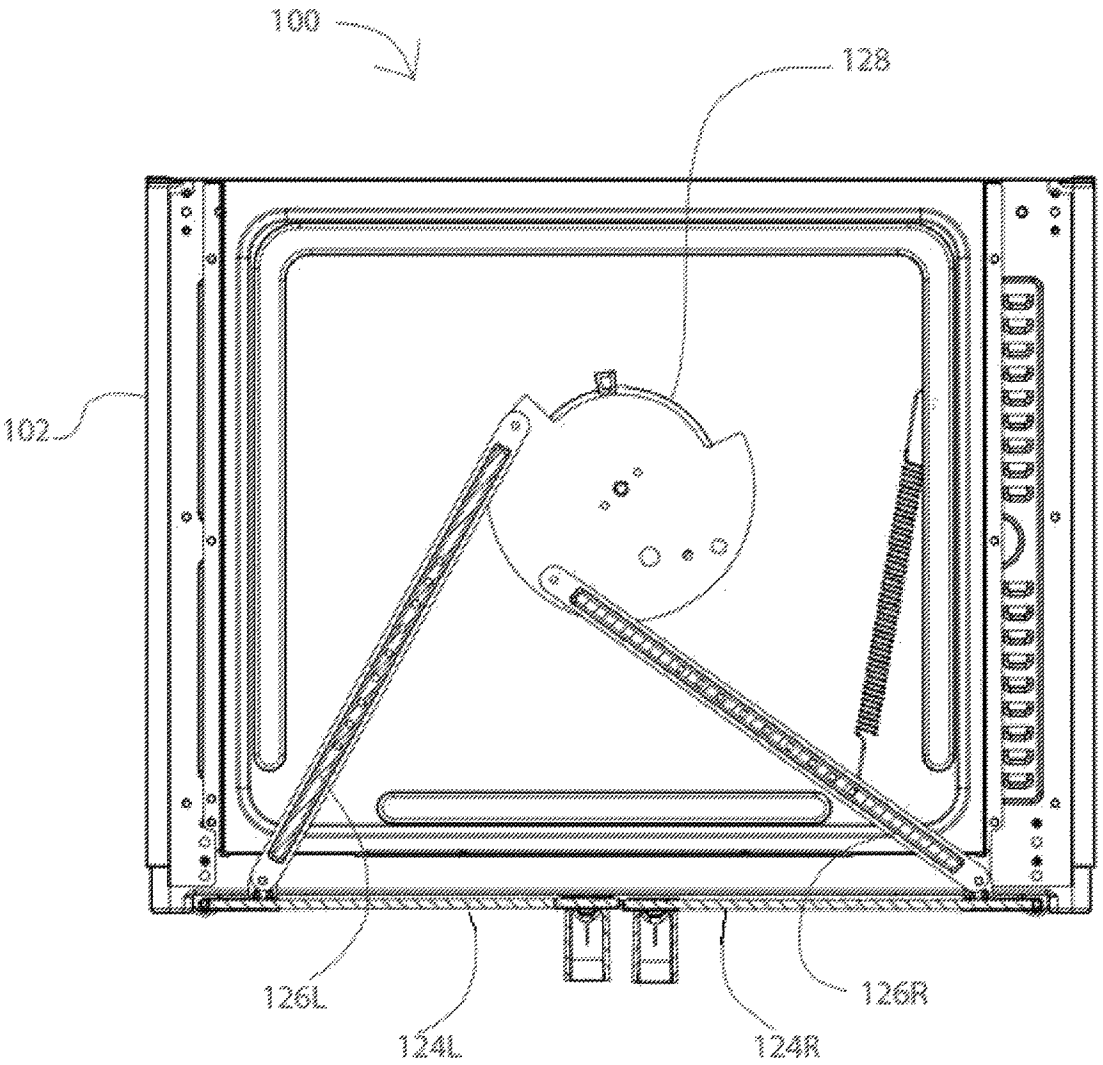
FIG. 11A is a cross-sectional view of the appliance of FIG. 1 in its closed state, taken at Line 11A-11A of FIG. 2.
Figure 11B:
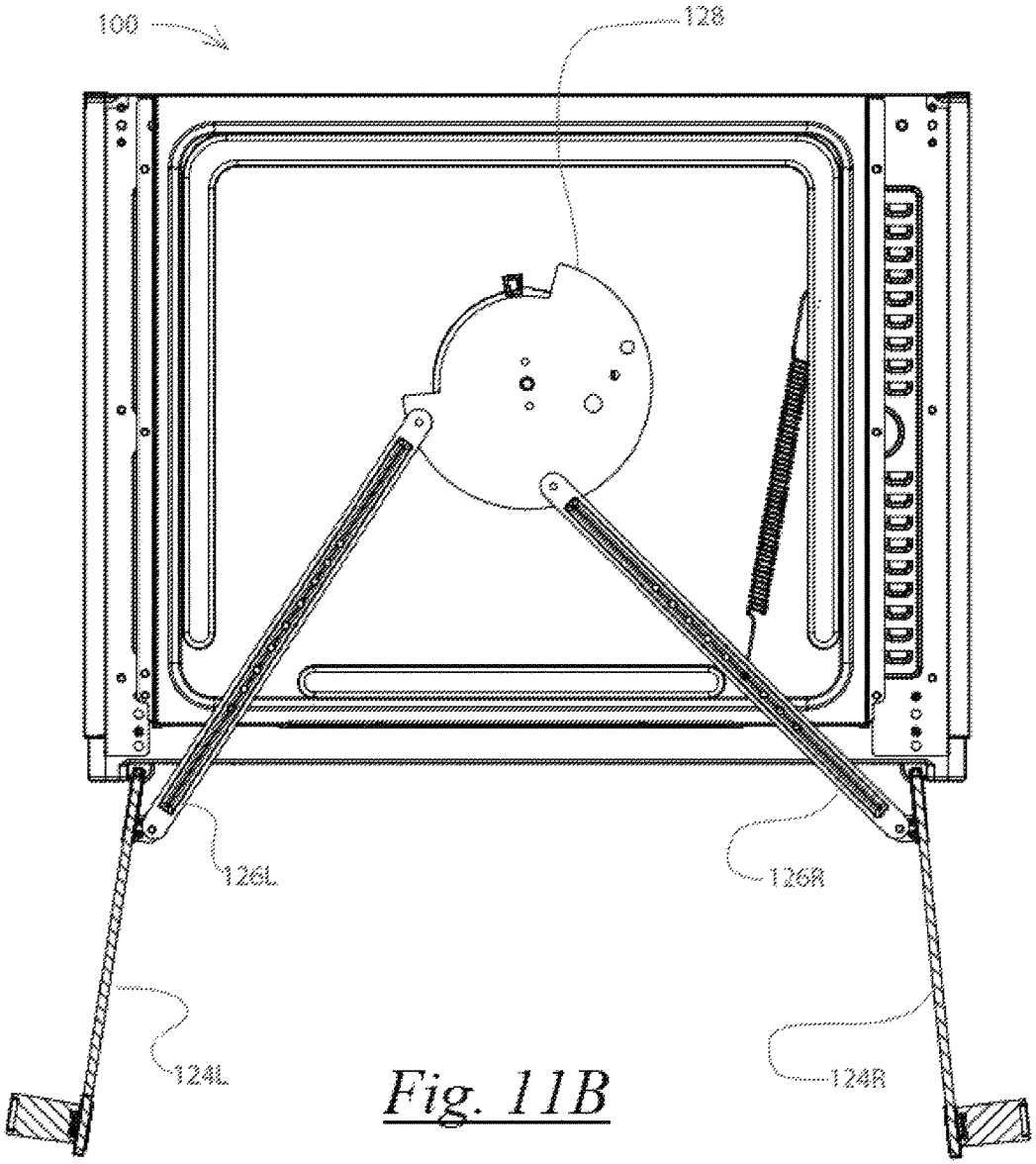
FIG. 11B is a cross-sectional view of the appliance of FIG. 1 in its opened state, taken at Line 11B-11B of FIG. 7B.
Figure 12A:
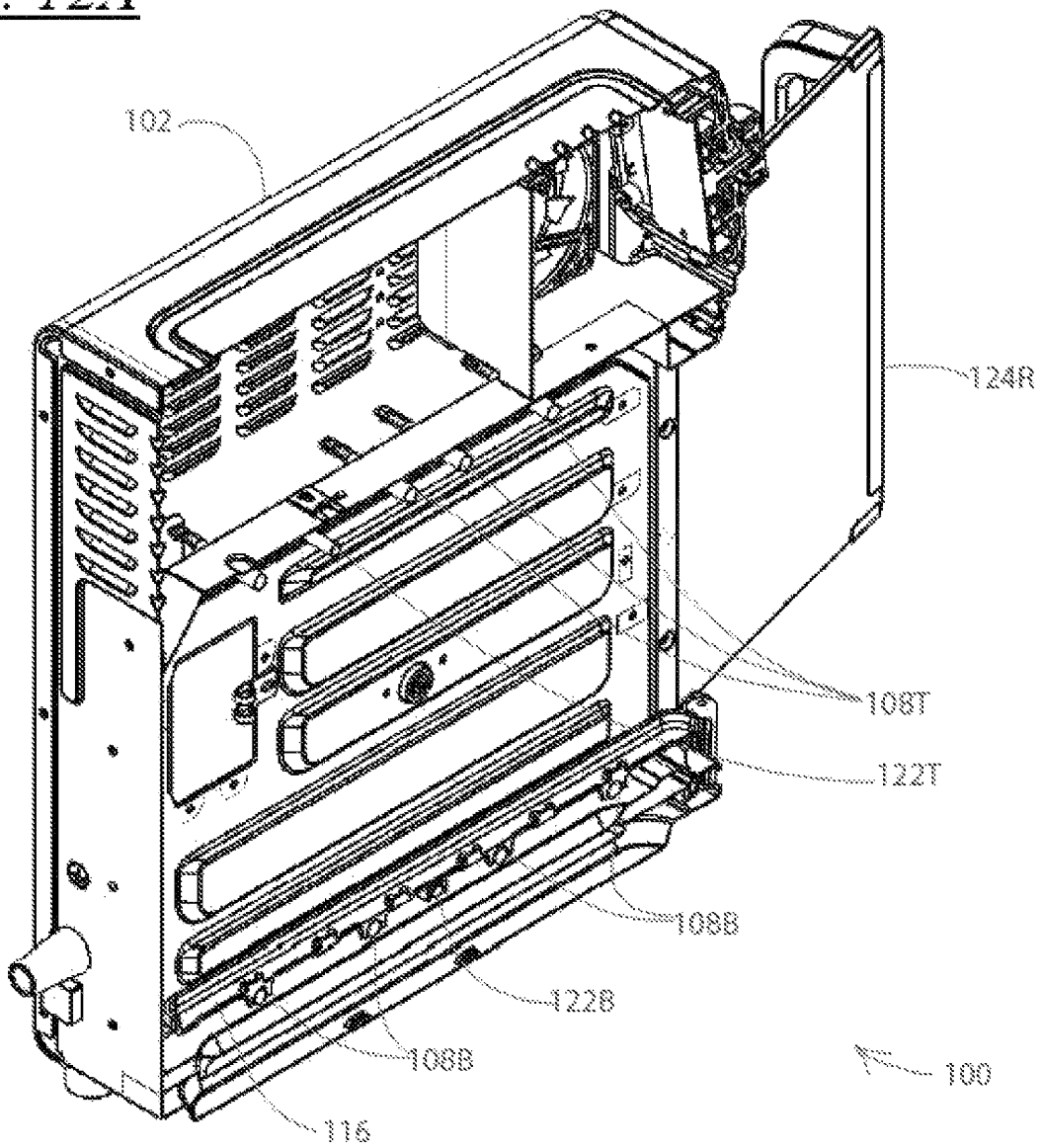
FIG. 12A is a cross-sectional perspective view of the appliance of FIG. 1 in its opened state, taken at Line 12A-12A of FIG. 7A.
Figure 12B:
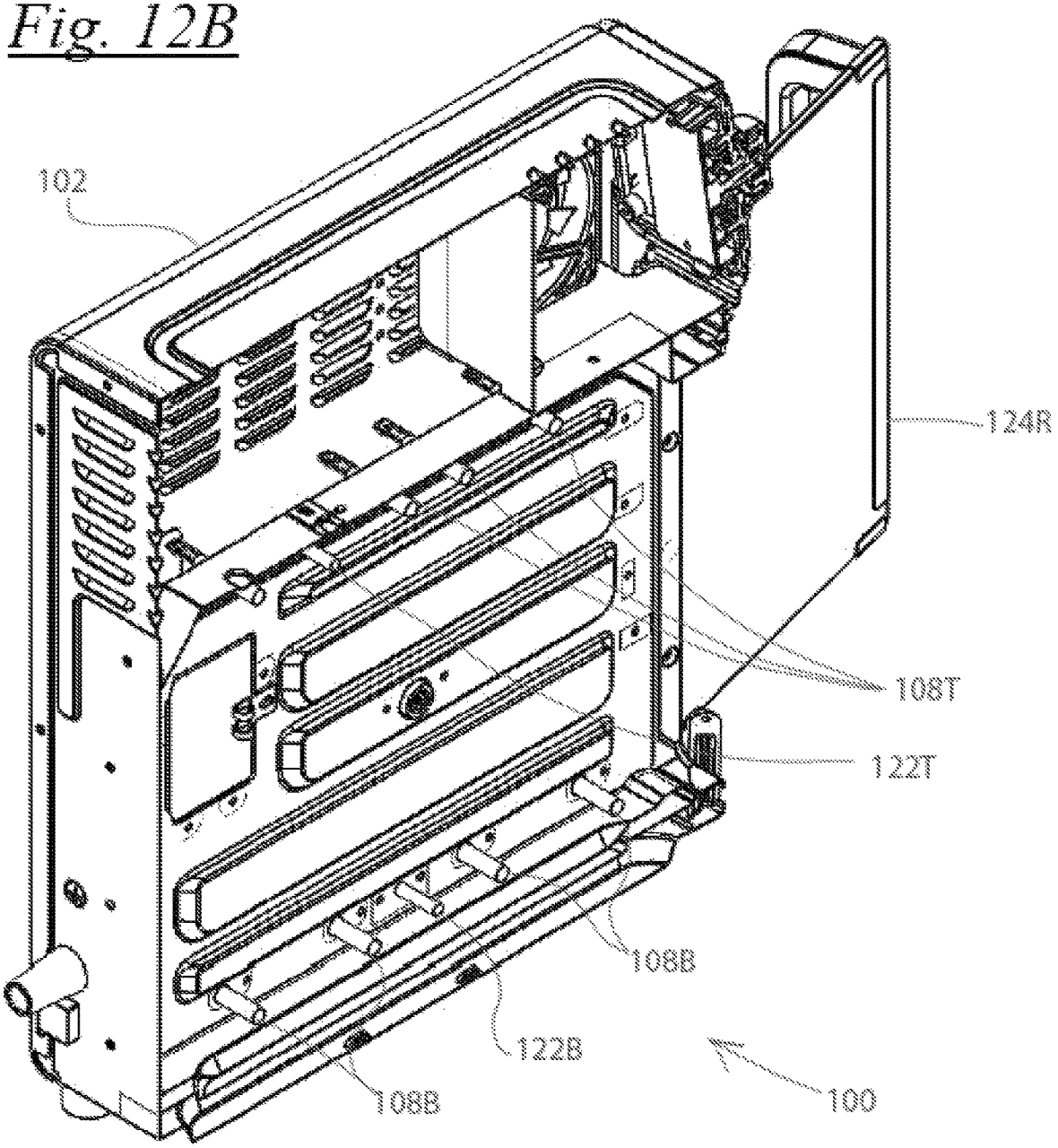
FIG. 12B is a cross-sectional perspective view of the appliance of FIG. 1 in its opened state with its griddle plate removed, taken at Line 12B-12B of FIG. 7B.
Figure 13A:
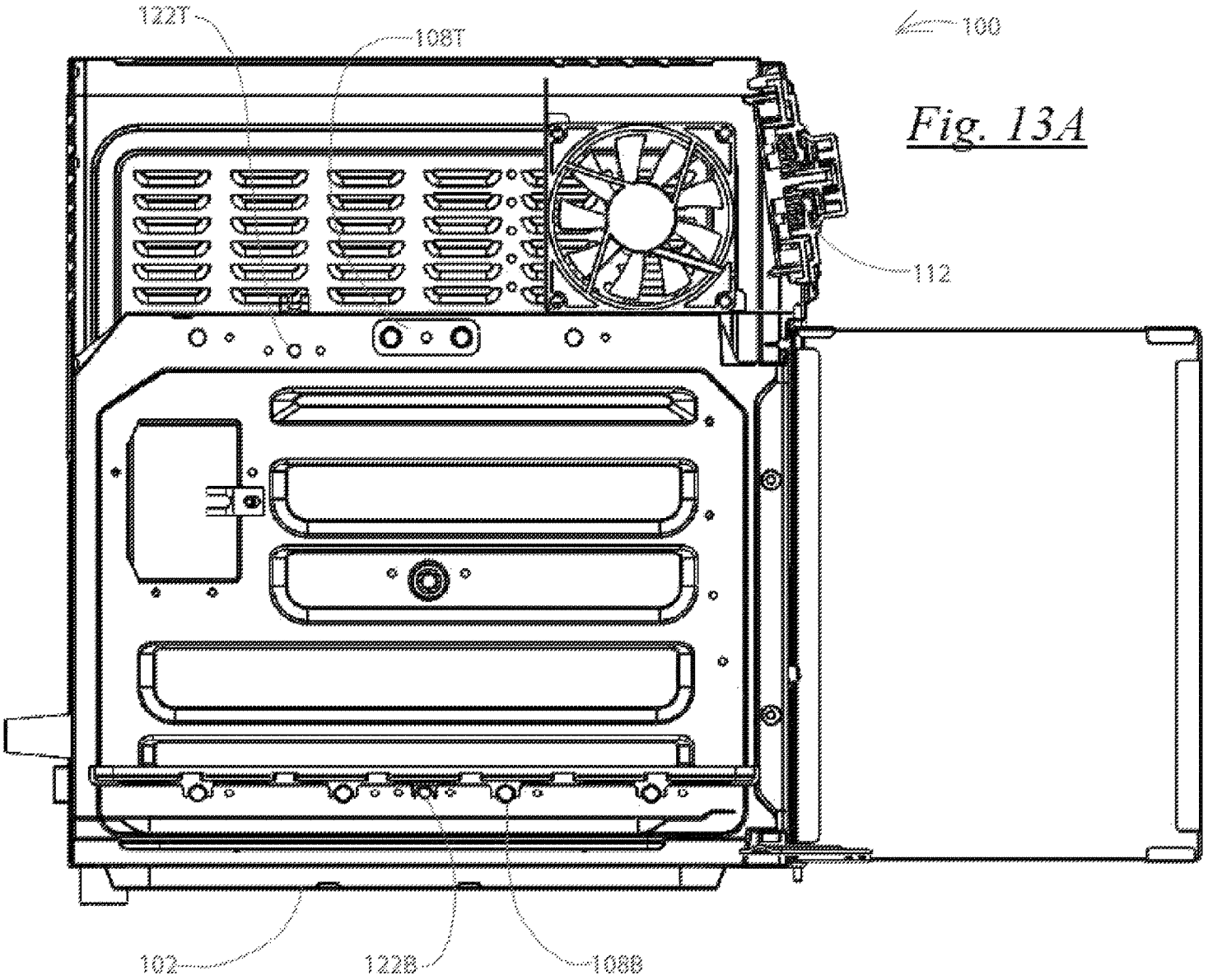
FIG. 13A is a is a cross-sectional view of the appliance of FIG. 1 in its opened state, taken at Line 13A-13A of FIG. 7A.
Figure 13B:
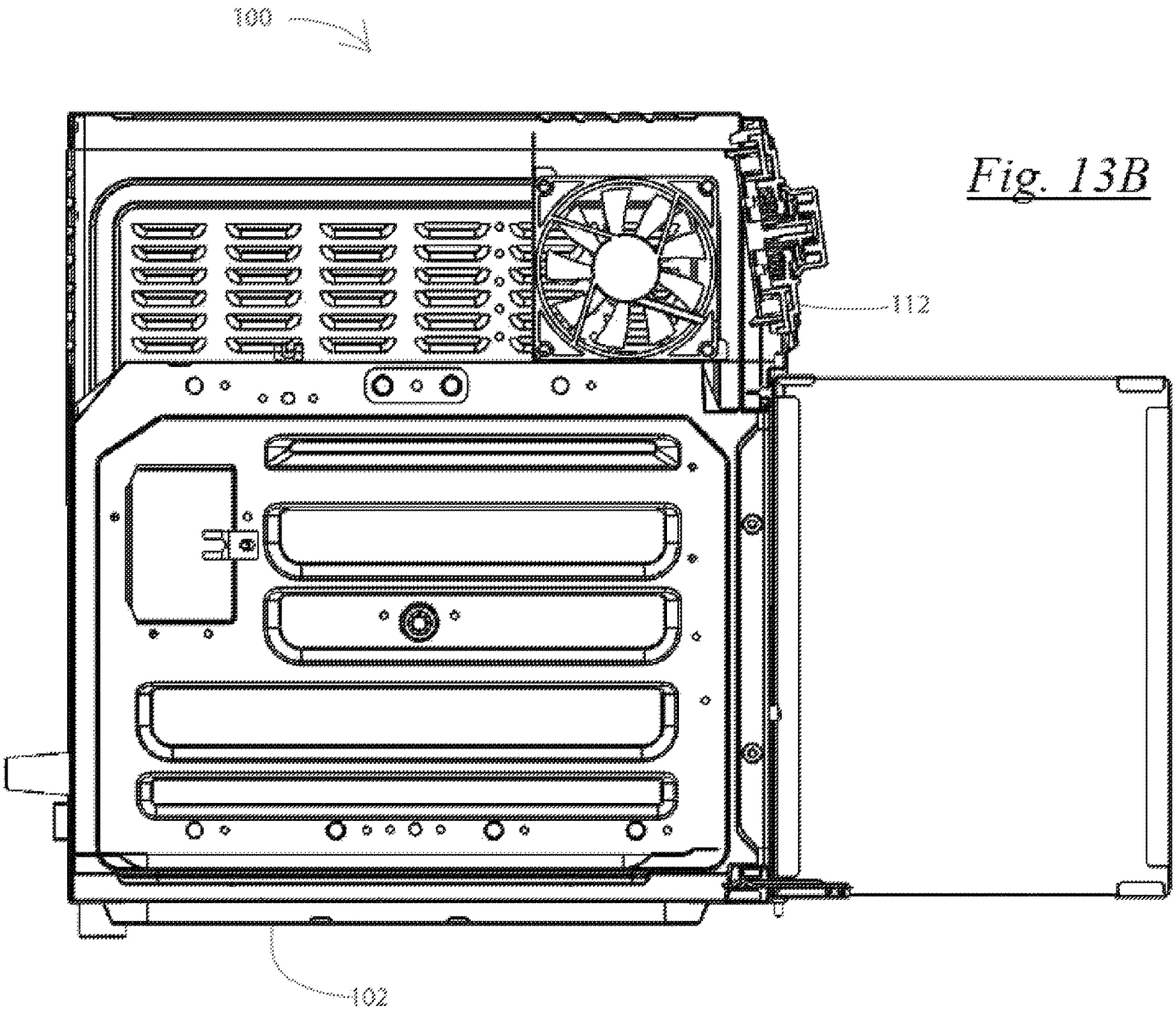
FIG. 13B is a is a cross-sectional view of the appliance of FIG. 1 in its opened state with its griddle plate removed, taken at Line 13B-13B of FIG. 7B.
Figure 14:
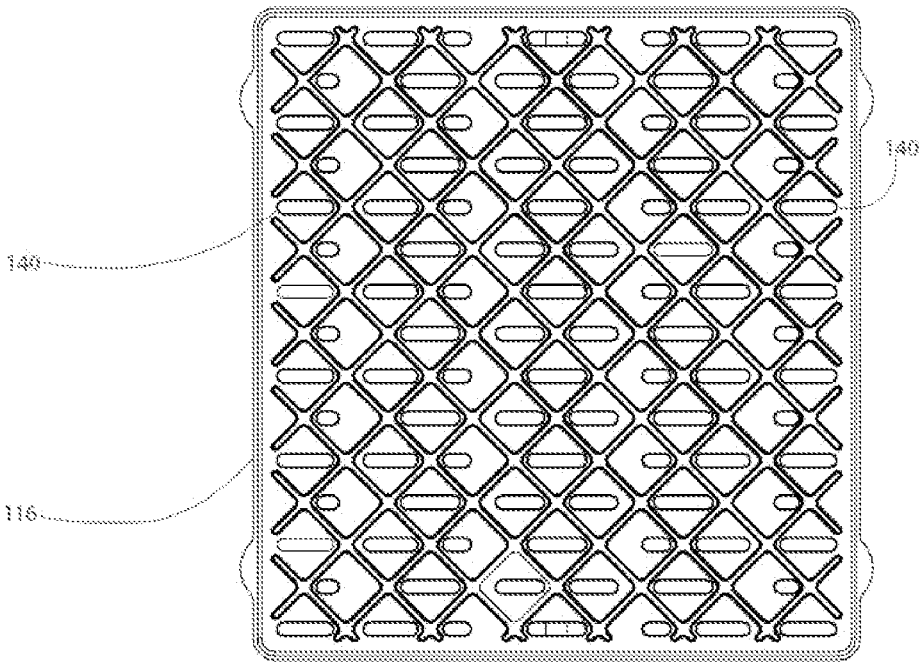
FIG. 14 is a top view of the removable griddle plate of the appliance of FIG. 1.
Figure 15:
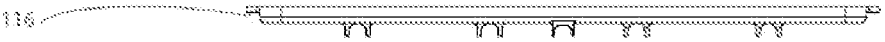
FIG. 15 is a front view of the removable griddle plate of the appliance of FIG. 1.
Figure 16:
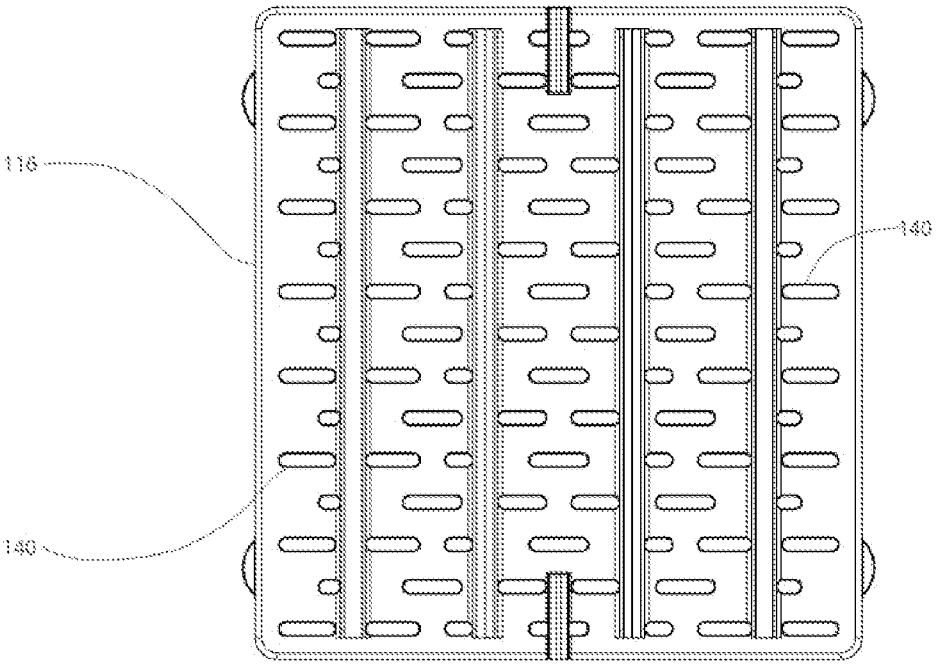
FIG. 16 is a bottom view of the removable griddle plate of the appliance of FIG. 1.

The symmetrical opening and closing of the left and right outwardly opening doors are achieved by the mechanism shown in FIGS. 11A and 11B. Link bars 126L and 126R connect the door to rotatable cam 128. An opening or closing force on either of the doors transmits through the associated link and causes rotation of the cam. That rotation of the cam transmits a force through the other link which causes equivalent opening or closing of the other door.

Having the first and second heating elements placed at the top and bottom of the cooking chamber, respectively, provides a space saving arrangement. In comparison to an existing appliance being able to cook a certain volume of food, this arrangement can either allow a smaller appliance to cook the certain volume of food or in a same-sized appliance to cook a larger volume of food. Because counterspace is so limited and valuable in most kitchens, this is no trivial benefit.

The combination or high-speed air agitation with both radiant and contact heating is found to speed up cooking and improve the quality of the cooked food in both mouth-appeal and eye-appeal. Exposing the food to fast-flowing heated air during cooking results in a vaporization of the grease produced during cooking so that it does not burn on the griddle plate and cause smoke, and so that it can be removed from the food and cooking cavity and collected by the exhaust filter, which is adapted to capture both smoke and grease and be easily removed for cleaning or replacement. Such advances far exceed the performance of existing ovens, toaster ovens, griddles, convection ovens, air fryers, etc., beyond what one would normally anticipate, thereby providing an unexpected result not made obvious by those individual appliances of the prior art.

While the blower is shown positioned at the top of the cooking cavity, its position is not critical so long as it fully agitates the air throughout the cavity. It pulls fresh air into the cooking cavity and expels the hot, smokey, and greasy air out through exhaust filter 138 to provide rapid recycling of the air and constant interchange of the air inside the housing of the oven and outside air so that the food is cooked in clean air, which improved taste and appearance. As such, this arrangement, including the efficient exhaust filter, is especially well-adapted to reducing smoke and odor, as compared to exiting cooking ovens which agitate but do not recycle the air.

The precisely temperature-controlled cookware device inside the cooking cavity in combination with a rapid air agitator provides an unexpectedly efficient means of reducing the smoke normally generated from such cooking, at least by removing the grease faster and more efficiently.

While the invention has been shown and described with reference to a specific exemplary embodiment, it should be understood by those skilled in the art that various changes in form and detail may be made without departing from the spirit and scope of the invention, and that the invention should therefore only be limited according to the following claims, including all equivalent interpretation to which they are entitled.

The invention claimed is:

1. A cooking appliance comprising;

a housing defining a cooking cavity;

a door arrangement for selectively accessing the cooking compartment;

a non-contact air heating element disposed adjacent a top of the cooking cavity and adapted to selectively heat air within the cooking cavity;

a second heating element disposed entirely within the housing adjacent a bottom of the cooking cavity;

a temperature sensor disposed adjacent the top of the cooking cavity and adapted to sense a temperature of the air within the cooking cavity;

a blower arranged to agitate air within the cooking cavity;

a cookware device removably disposed atop and in thermal contact with the second heating element, such that heating of the cookware device is selectively provided thereby; and a controller adapted to manually receive cooking parameters from a user and sensed temperature information from the temperature sensor; and to independently and selectively control the heating elements and the blower according thereto; wherein the door arrangement comprises left and right outwardly-opening doors;

and wherein the second heating element comprises two or more tubular rod type elements which span entirely across the bottom of the cooking cavity adjacent the cookware device.

2. The cooking appliance of claim 1 wherein the left and right outwardly-opening doors are linked together to open and close symmetrically such that opening or closing either one will cause a symmetrical opening or closing of the other.

3. The cooking appliance of claim 2 wherein the left and right outwardly-opening doors are linked together to open and close symmetrically through a linkage mechanism that comprises:

a cam rotatably affixed to the housing;

a left link hingedly affixed to the left opening door and rotatably linked to the cam;

a right link hingedly affixed to the right opening door and rotatably linked to the cam; wherein an opening or closing force on either of the doors transmits through the associated link and causes rotation of the cam; and the rotation of the cam transmits a force through the other link which causes equivalent opening or closing of the other door.

4. The cooking appliance of claim 3 wherein the cookware device is a griddle plate.

5. An electrical countertop cooking appliance comprising;

a housing defining a cooking cavity;

a door arrangement for selectively accessing the cooking compartment;

a non-contact air heating element disposed adjacent a top of the cooking cavity and adapted to selectively heat air within the cooking cavity;

a second heating element disposed entirely within the housing adjacent a bottom of the cooking cavity;

a temperature sensor disposed adjacent the top of the cooking cavity and adapted to sense a temperature of the air within the cooking cavity;

a blower arranged to agitate air within the cooking cavity;

a cookware device removably disposed atop and in thermal contact with the second heating element, such that heating of the cookware device is selectively provided thereby; and a controller adapted to manually receive cooking parameters from a user and sensed temperature information from the temperature sensor;

wherein the controller connected to the heating elements and comprising a timer and adapted to independently and selectively control, in cooperation with the timer and according to the cooking parameters and the sensed temperature information one or more from the group including;

one or both of the blower's on/off state and the blower's speed;

one or both of the first heating element's on/off state and the blower's speed; and one or both of the second heating element's on/off state and the blower's speed; wherein the door arrangement comprises left and right outwardly-opening doors; and wherein the second heating element comprises two or more tubular rod type elements which span entirely across the bottom of the cooking cavity adjacent the cookware device.

6. The cooking appliance of claim 5 wherein the left and right outwardly-opening doors are linked together to open and close symmetrically such that opening or closing either one will cause a symmetrical opening or closing of the other.

7. The cooking appliance of claim 6 wherein the left and right outwardly-opening doors are linked together to open and close symmetrically through a linkage mechanism that comprises:

a cam rotatably affixed to the housing;

a left link hingedly affixed to the left opening door and rotatably linked to the cam;

a right link hingedly affixed to the right opening door and rotatably linked to the cam; wherein an opening or closing force on either of the doors transmits through the associated link and causes rotation of the cam; and the rotation of the cam transmits a force through the other link which causes equivalent opening or closing of the other door.

8. The cooking appliance of claim 7 wherein the cookware device is a griddle plate.

9. An electrical countertop cooking appliance comprising;

a housing defining a cooking cavity;

a door arrangement for selectively accessing the cooking compartment;

a non-contact air heating element disposed adjacent a top of the cooking cavity and adapted to selectively heat air within the cooking cavity;

a second heating element disposed entirely within the housing adjacent a bottom of the cooking cavity;

a first temperature sensor disposed adjacent the top of the cooking cavity and adapted to sense a temperature of the air within the cooking cavity;

a second temperature sensor disposed adjacent the bottom of the cooking cavity;

a blower arranged to agitate air within the cooking cavity;

a cookware device removably disposed atop and in thermal contact with the second heating element, such that contact-heating of the cookware device is selectively provided thereby, and the second temperature sensor, such that contact temperature sensing of the cookware device is enabled thereby; and a controller adapted to manually receive cooking parameters from a user and sensed temperature information from the first and second temperature sensors; wherein the controller connected to the heating elements and comprising a timer and adapted to independently and selectively control, in cooperation with the timer and according to the cooking parameters and the sensed temperature information one or more from the group including;

one or both of the blower's on/off state and the blower's speed;

one or both of the first heating element's on/off state and the blower's speed; and one or both of the second heating element's on/off state and the blower's speed;

wherein the door arrangement comprises left and right outwardly-opening doors; and wherein the second heating element comprises two or more tubular rod type elements which span entirely across the bottom of the cooking cavity adjacent the cookware device.

10. The cooking appliance of claim 9 wherein the cookware device is a perforated griddle plate adapted to allow agitated air to pass there-through.

11. The cooking appliance of claim 10 wherein the door arrangement comprises left and right outwardly-opening doors.

12. The cooking appliance of claim 11 wherein the left and right outwardly-opening doors are linked together to open and close symmetrically such that opening or closing either one will cause a symmetrical opening or closing of the other.

13. The cooking appliance of claim 12 wherein the left and right outwardly-opening doors are linked together to open and close symmetrically through a linkage mechanism that comprises:

a cam rotatably affixed to the housing;

a left link hingedly affixed to the left opening door and rotatably linked to the cam;

a right link hingedly affixed to the right opening door and rotatably linked to the cam; wherein an opening or closing force on either of the doors transmits through the associated link and causes rotation of the cam; and the rotation of the cam transmits a force through the other link which causes equivalent opening or closing of the other door.

14. The cooking appliance of claim 13 wherein the cookware device is a griddle plate.

* * * * *